US007467816B2

(12) United States Patent
Nakagawa et al.

(10) Patent No.: US 7,467,816 B2
(45) Date of Patent: Dec. 23, 2008

(54) DOOR LATCH DEVICE

(75) Inventors: Hayami Nakagawa, Anjo (JP); Yasuji Akiyoshi, Nagoya (JP); Takashi Shibata, Okazaki (JP)

(73) Assignee: Mitsubishi Jidosha Kogyo K.K., Tokyo (JP)

( * ) Notice: Subject to any disclaimer, the term of this patent is extended or adjusted under 35 U.S.C. 154(b) by 104 days.

(21) Appl. No.: 11/285,181

(22) Filed: Nov. 23, 2005

(65) Prior Publication Data

US 2006/0119109 A1 Jun. 8, 2006

(30) Foreign Application Priority Data

Nov. 25, 2004 (JP) ..... P2004-339806

(51) Int. Cl.
*E05C 3/06* (2006.01)

(52) U.S. Cl. ..... 292/216; 292/DIG. 56

(58) Field of Classification Search ..... 292/216, 292/DIG. 56
See application file for complete search history.

(56) References Cited

U.S. PATENT DOCUMENTS 4,783,103 A * 11/1988 Schlegel ..... 292/216
4,971,373 A * 11/1990 Hamada et al. ..... 292/216
5,961,164 A * 10/1999 Gomi ..... 292/216
6,749,234 B2 * 6/2004 Bruce ..... 292/216
6,789,825 B2 * 9/2004 Kalargeros et al. ..... 292/216

FOREIGN PATENT DOCUMENTS

| | | | |
|---|---|---|---|
| DE | 2 320 351 | A | 10/1974 |
| DE | 36 05 601 | C1 | 2/1987 |
| DE | 39 32 268 | C2 | 6/1990 |
| DE | 19821754 | A1 | 12/1998 |
| DE | 102 44 161 | A1 | 8/2003 |
| JP | 06-000524 | Y2 | 1/1994 |
| JP | 06-016002 | Y2 | 4/1994 |

* cited by examiner

*Primary Examiner*—Gary Estremsky
(74) *Attorney, Agent, or Firm*—Birch, Stewart, Kolasch & Birch, LLP

(57) ABSTRACT

A door latch device includes a striker, a fork, a pawl lever that locks rotation of the fork, the fork having a first locking part which locks the striker when the fork is shifted from an open state though a half-grasped state to a full-grasped state and a second locking part which is locked with the pawl lever in the half-grasped state, a stopper member which restricts rotation of the pawl lever, and a sound adjusting unit that makes a first striking sound which occurs when the striker strikes the first locking part larger than a third striking sound which occurs when the pawl lever strikes the stopper member is in the full-grasped state of the fork, and that makes a second striking sound which occurs when the pawl lever strikes the second locking part larger than the third striking sound.

2 Claims, 6 Drawing Sheets

STRIKING SOUNDS

DOOR LATCH DEVICE

BACKGROUND OF THE INVENTION

1. Field of the Invention

The present invention relates to a door latch device.

2. Description of the Related Art

Generally, a door or the like of a vehicle is provided with a door latch device. The door latch device includes a striker which is provided on either one of a vehicle body and the door, and a fork (hook) and a pawl lever (ratchet) which is provided on the other. The fork is a member for grasping and releasing the striker, while the pawl lever is a member for holding the fork in a state where the striker is grasped by the fork. The fork is always urged in a direction of releasing the striker, and the door latch will be released by rotating or moving the pawl lever into a position not in mesh with the fork. The door is adapted to be closed or opened by employing such door latch device.

However, when the door is closed, striking sounds 1, 2 and 3 successively occur from the door latch device, as shown in FIG. 7. The striking sound 1 occurs when the striker strikes the fork, after the striker has entered into the latch. The striking sound 2 occurs when the pawl lever strikes the fork for locking the rotation of the fork so as to bring the door into a so-called half-latched state, after the striker has further entered to rotate the fork. The striking sound 3 occurs when the pawl lever strikes a rubber damper or the like for the purpose of finally locking the rotation of the fork so as to bring the door into a so-called full-latched state, after the striker has further entered to rotate the fork.

The above described striking sounds 1, 2, 3 will make passengers uncomfortable in some cases, and so, there has been proposed a door latch device for preventing occurrence of the striking sounds 1, 2, 3, as shown in FIG. 8, by applying a muffling structure to the striker, fork and pawl lever. The conventional door latch devices of this type are disclosed, for example, in JP-UM-B-6-524 and JP-UM-B-6-16002.

However, opening and closing speed of the door varies depending on each passenger, and the conventional door latch device has not been in compliance with such opening and closing speed of the door. Particularly, when the door is opened, the position of the pawl lever to be butted against the fork for engagement varies according to the closing speed of the door, and naturally, the striking sound will change. For this reason, a user may feel uneasy about locking the door, due to the change in the striking sound. Additionally, the conventional door latch device has been designed in such a manner that sound pressure level of the closing sound of the door may be reduced, for the purpose of enhancing quality of the vehicle. On the other hand, feeling of click has not been considered. Moreover, in recent years, some users have a great respect to quality of sound, tone of sound, volume level of sound, etc., and such requests have been more and more increased. Besides, it is not considered that improvement in quality of the vehicle can be achieved only by reducing the closing sound of the door.

Under the circumstances, the invention has been made in order to solve the above described problem, and an object of the invention is to provide a door latch device which stably generates a striking sound, even though a closing speed of a door has changed, and at the same time, to provide a door latch device which can impart an enhanced quality to a vehicle, by improving tone of the occurring sound, without lowering sound pressure, and such identity as different from other vehicles.

SUMMARY OF THE INVENTION

According to an aspect of the present invention, a door latch device includes a striker, a fork that grasps or releases the striker, a pawl lever that locks rotation of the fork in a half-grasped state or in a full-grasped state of the fork, the fork having a first locking part which locks the striker when the fork is shifted from an open state through the half-grasped state to the full-grasped state and a second locking part which is locked with the pawl lever in the half-grasped state, a stopper member which restricts rotation of the pawl lever, and a sound adjusting unit that makes a first striking sound which occurs when the striker strikes the first locking part larger than a third striking sound which occurs when the pawl lever strikes the stopper member in the full-grasped state of the fork, and that makes a second striking sound which occurs when the pawl lever strikes the second locking part larger than the third striking sound.

According to the above-described features of the present invention, feeling of click can be obtained as well as improvement in quality of the vehicle, and a different identity can be provided from other vehicles.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
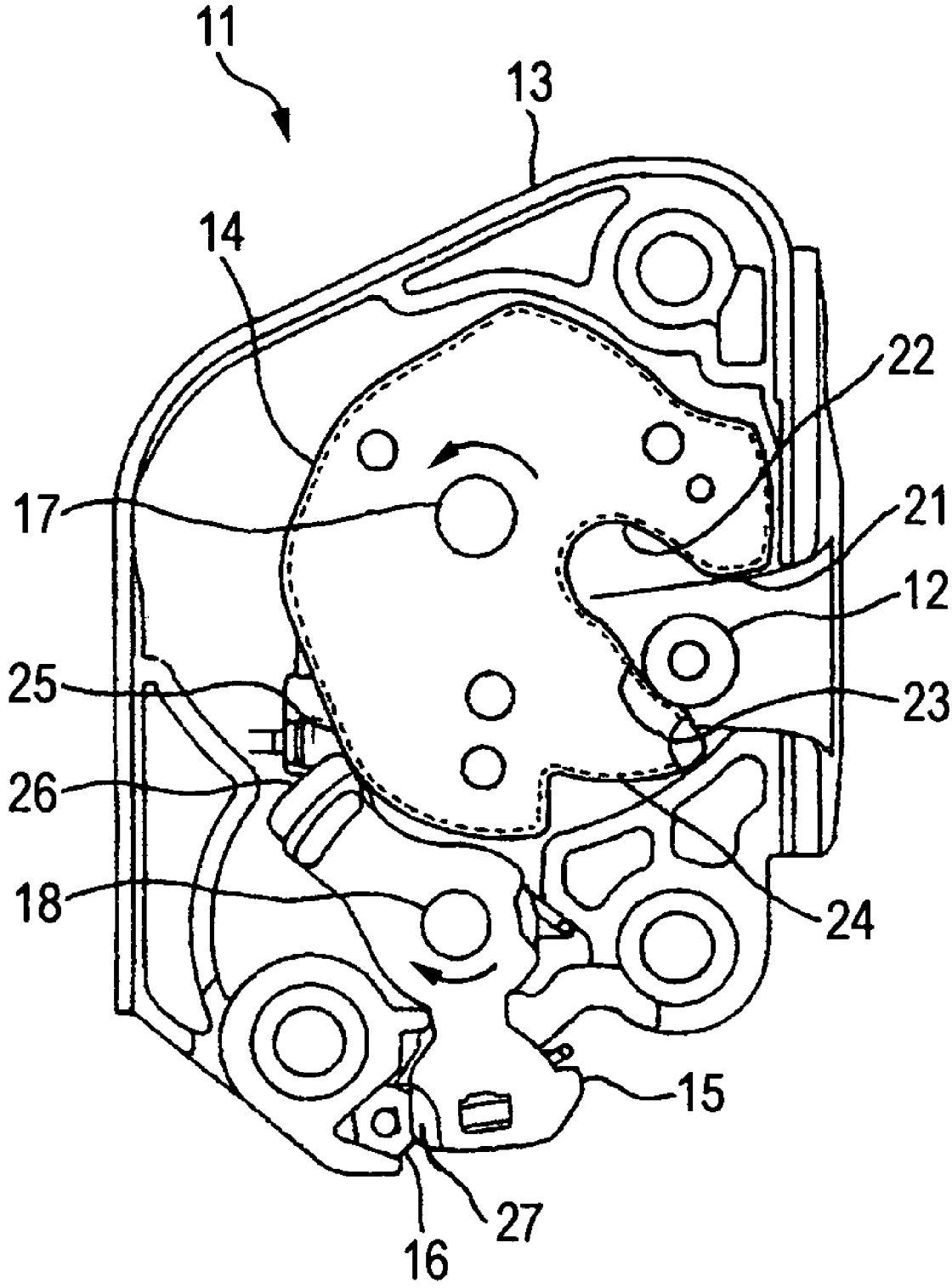
FIG. 1 is a schematic view of a door latch device according to a first embodiment of the invention.
Figure 3C:
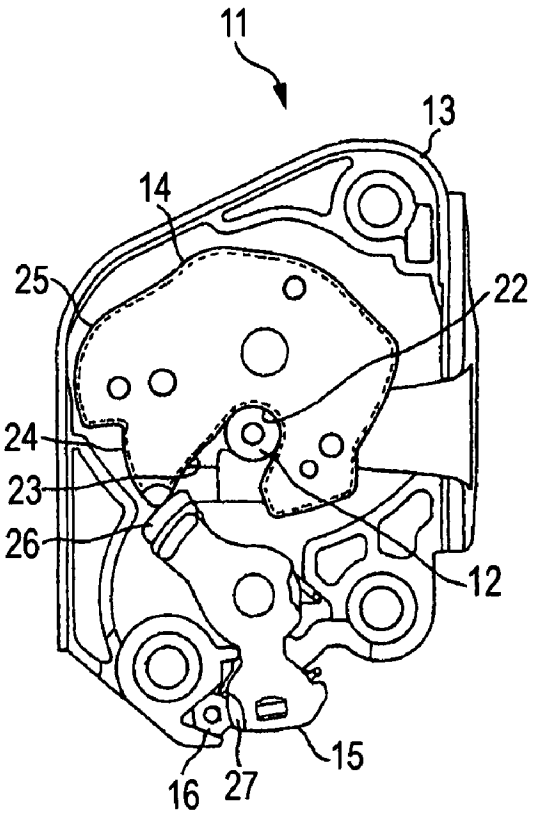
FIG. 3C is a view showing a full-latched state of the door latch device.
Figure 3B:
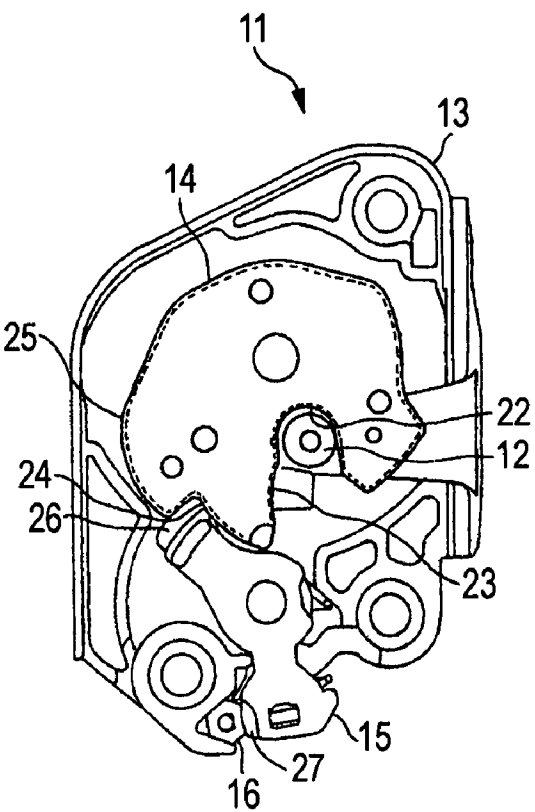
FIG. 3B is a view showing a half-latched state of the door latch device.
Figure 3A:
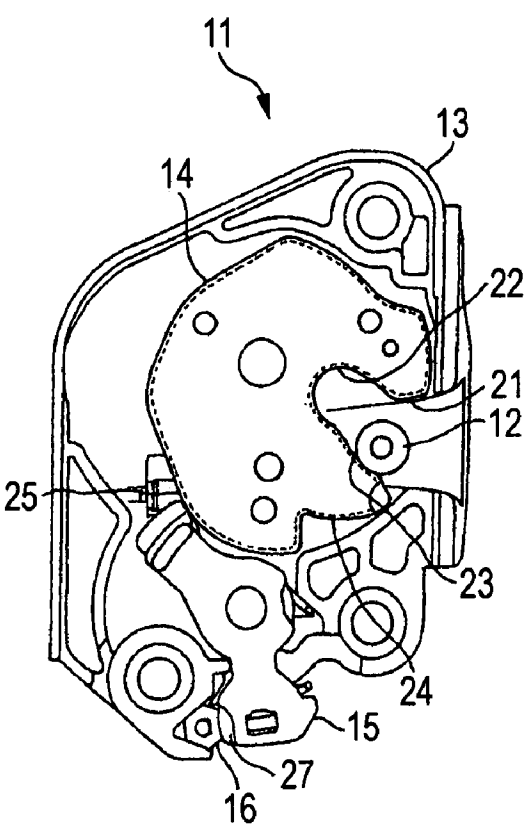
FIG. 3A is a view showing an open state of the door latch device.
Figure 4:
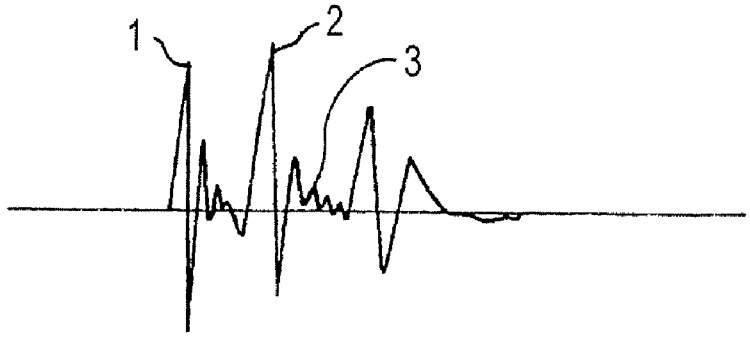
FIG. 4 is a view showing a waveform of sound pressure when the door latch device of the invention is employed.
Figure 5:
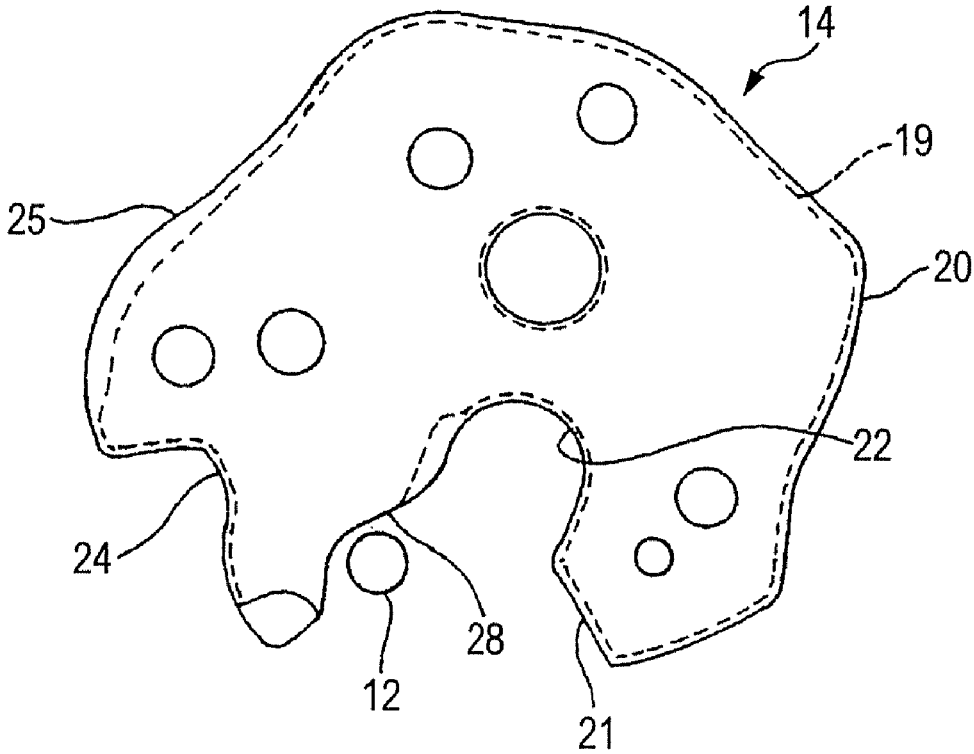
FIG. 5 is a schematic view of a modification of the fork.
Figure 6:
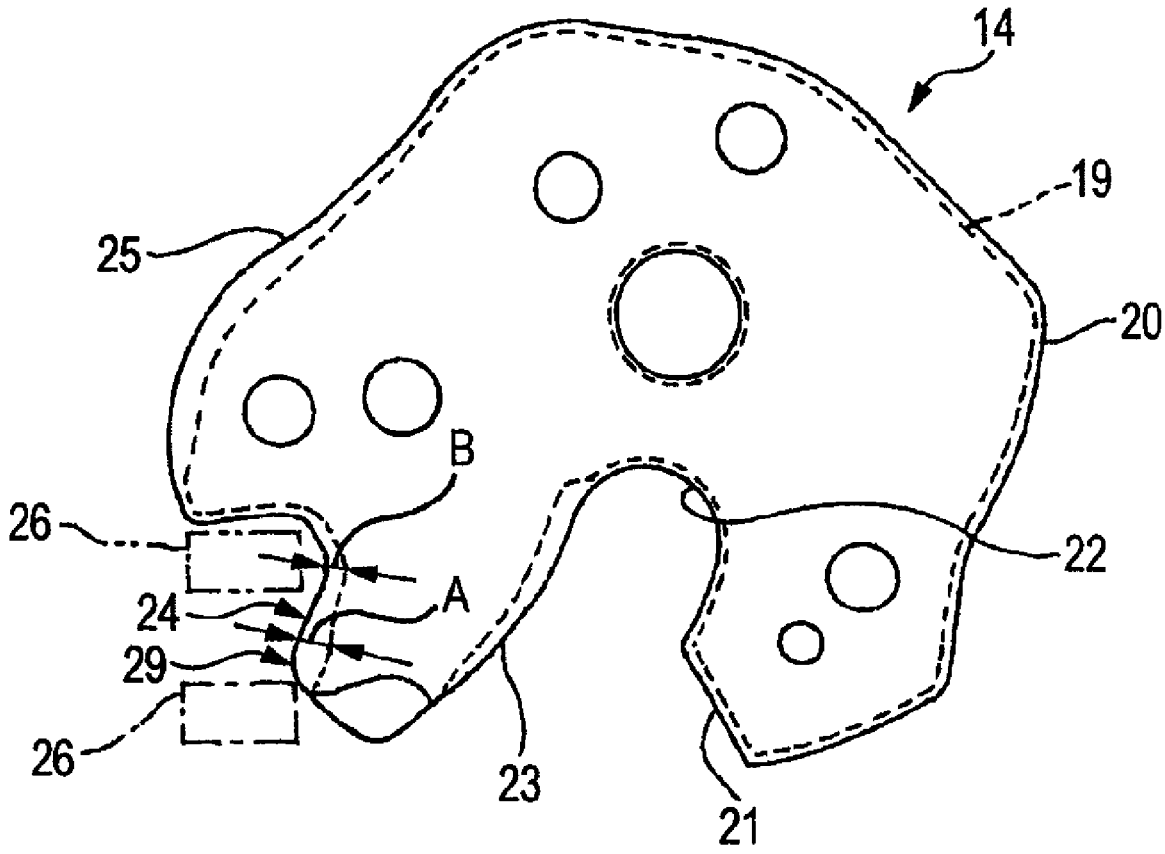
FIG. 6 is a schematic view of another modification of the fork.
Figure 7:
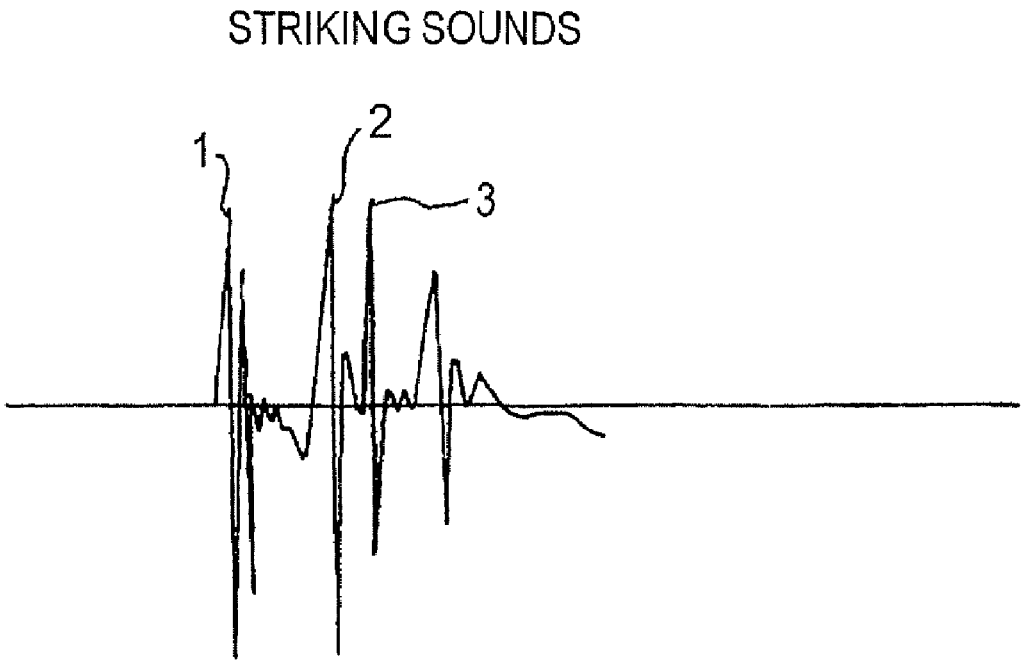
FIG. 7 is a view showing a waveform of sound pressure when the door latch device according to a conventional case is employed.
Figure 8:
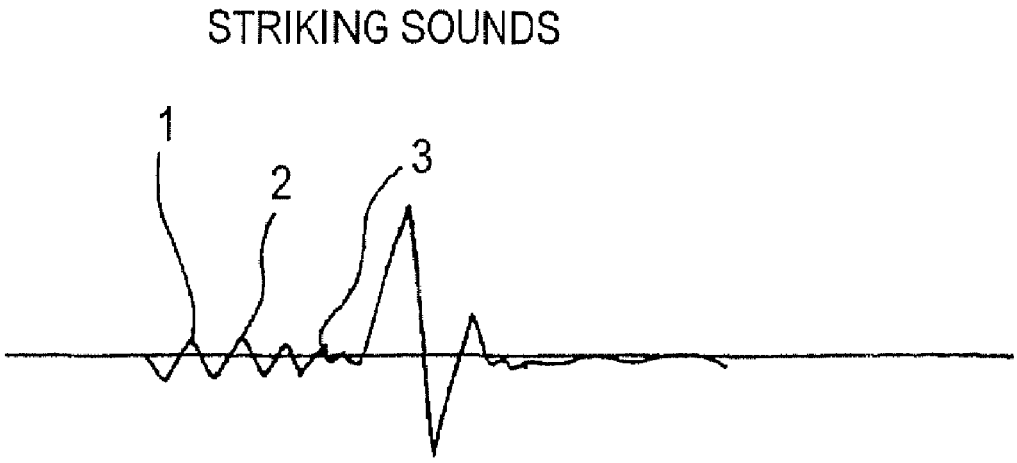
FIG. 8 is a view showing a waveform of sound pressure when a muffling structure is employed in the door latch device according to the conventional case.

Now, an embodiment of the invention will be described in detail, referring to the drawings. FIG. 1 is a schematic view of a door latch device according to an embodiment of the invention, FIG. 2 is a schematic view of a fork, FIGS. 3A to 3C are views showing operation of the door latch device, FIG. 4 is a view showing a waveform of sound pressure when the door latch device of the invention is employed, and FIGS. 5 and 6 are schematic views of modifications of the fork.

As shown in FIG. 1, a door latch device 11 includes a striker 12 provided in a door (not shown) side, a main body 13 provided in a vehicle body (not shown) side, a fork 14, a pawl lever 15, and a damper rubber (stopper member) 16. The fork 14 and the pawl lever 15 are held on the main body 13 so as to rotate respectively around shafts 17 and 18, and urged by respective spring means (not shown) in a counterclockwise direction and in a clockwise direction, as shown by arrow marks in FIG. 1.

Figure 2:
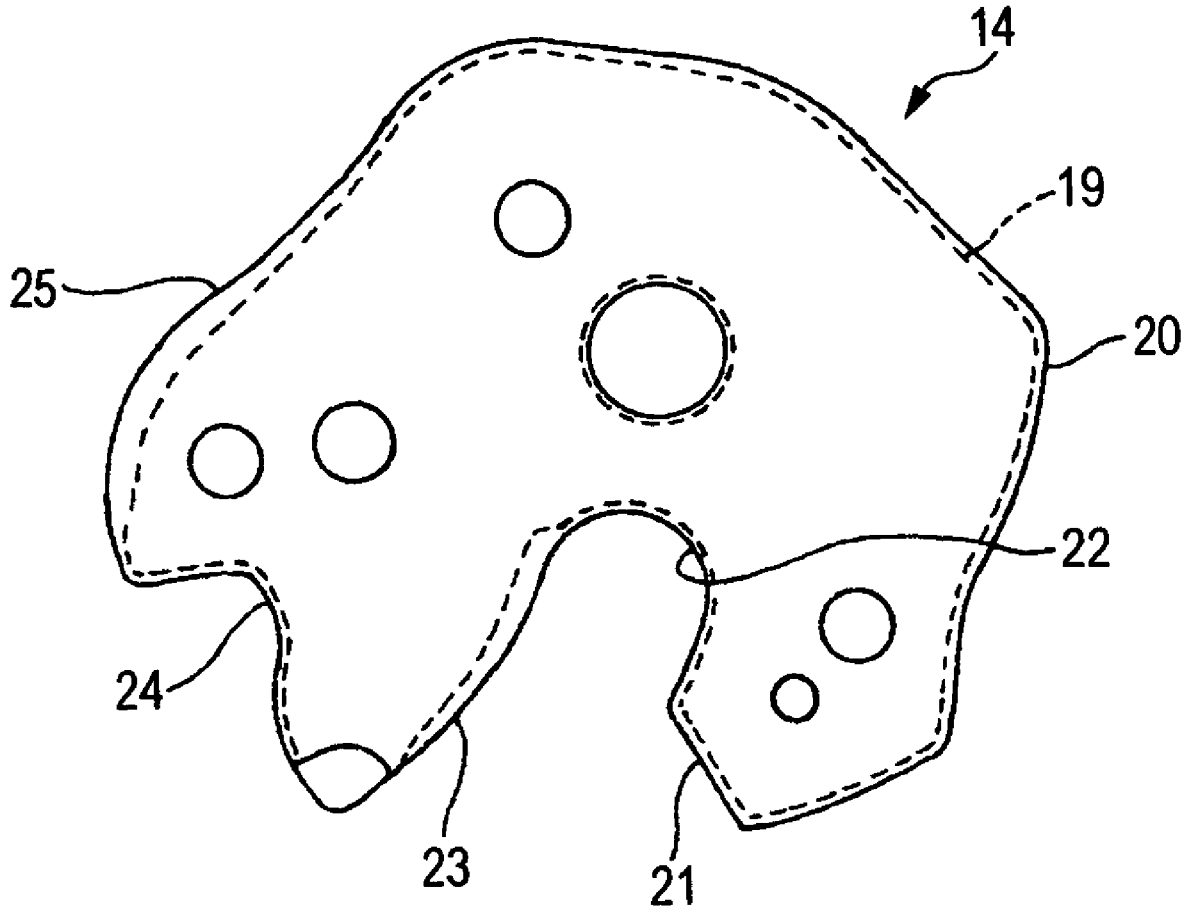
FIG. 2 is a schematic view of a fork.

As shown in FIG. 2, the fork 14 is formed of a metal piece 19 coated with a thin resin 20. The fork 14 is provided with an open part 21 into which the striker 12 will enter when the door is closed, and a grasping part 22 for grasping the striker 12 which has entered from the open part 21. Moreover, the fork 14 is provided with a locking part (a first locking part) 23 for locking the striker 12 when the fork is shifted from an open state (a released state) to a half-latched state (half-grasped state), which will be described below, a locking part (a second locking part) 24 which is locked with the pawl lever 15 in the half-latched state, and a locking part 25 which is locked with the pawl lever 15 in the open state.

The pawl lever 15 has a pawl part 26 which is adapted to be engaged with the fork 14, and a butting part 27 which is adapted to be butted against the damper rubber 16. The pawl part 26 will be engaged with the locking parts 24 and 25 in the above described half-latched state or the open state of the fork 14, and the butting part 27 will be butted against the damper rubber 16 thereby to restrict the rotation of the pawl lever 15.

As shown in FIGS. 3A to 3C, when the door is closed from the open state in FIG. 3A, the striker 12 enters into the open part 21 of the fork 14 and will be locked by the locking part 23. On this occasion, when the striker 12 is butted against the locking part 23 of the fork 14, a striking sound 1 (a first striking sound) will occur.

As the striker 12 further enters, the striker 12 will press the fork 14 while the striker is embraced by the grasping part 22, as shown in FIG. 3B. With this action, the fork 14 is rotated around the shaft 17 in a clockwise direction against urging force of the spring means. After the fork 14 has been rotated by a determined amount, the locking part 25 will press the pawl part 26 of the pawl lever 15, whereby the pawl lever 15 will be rotated around the shaft 18 in a counterclockwise direction against urging force of the spring means.

When the pawl part 26 of the pawl lever 15 has passed by the locking part 25, the pawl lever 15 will be rotated in a clockwise direction by the urging force of the spring means, and the pawl part 26 of the pawl lever 15 will be locked to the locking part 24. This state is, in short, the half-latched state. On this occasion, when the pawl part 26 of the pawl lever 15 is butted against the locking part 24 of the fork 14, a striking sound 2 (a second striking sound) will occur.

As the striker 12 still further enters, the striker 12 will press the fork 14 while the striker is embraced by the grasping part 22, as shown in FIG. 3C. With this action, the fork 14 is rotated around the shaft 17 in a clockwise direction against the urging force of the spring means. When the fork 14 has been rotated by a determined amount, the locking part 24 will press the pawl part 26 of the pawl lever 15, whereby the pawl lever 15 will be rotated around the shaft 18 in a counterclockwise direction against the urging force of the spring means.

When the pawl part 26 of the pawl lever 15 has passed by the locking part 24, the pawl lever 15 will be rotated in a clockwise direction by the urging force of the spring means, and the butting part 27 of the pawl lever 15 will be butted against the damper rubber 16. With this action, the rotation of the pawl lever 15 will be stopped, and the pawl part 26 will be positioned near an inlet of the open part 21. This state is, in short, the full-latched state (fully grasped state) in which the door is locked. On this occasion, even though the butting part 27 of the pawl lever 15 is butted against the damper rubber 16, a striking sound 3 (a third striking sound) will hardly occur.

In order to release the lock, the pawl lever 15 will be rotated in a counterclockwise direction against the urging force of the spring means, thereby to release the pawl part 26 of the pawl lever 15 from the fork 14. With this action, the fork 14 will be rotated in a counterclockwise direction by the urging force of the spring means, as shown in FIG. 3A. Then, the pawl part 26 of the pawl lever 15 will be locked to the locking part 25, and at the same time, the striker 12 which has been grasped by the grasping part 22 will be released from the open part 21, whereby the door will open.

According to the above described structure, the sound pressures of the striking sounds 1, 2, 3, when the door latch device 11 of the invention is employed, will be as shown in FIG. 4.

Because the fork 14 is formed of the metal piece 19 coated with the thin resin 20, as shown in FIG. 2, the striking sound 1 which occurs when the striker 12 strikes the locking part 23, and the striking sound 2 which occurs when the pawl part 26 of the pawl lever 15 strikes the locking part 24 can be set at predetermined sound pressures. Moreover, because the fork 14 coated with the thin resin 20 has lower muffling effect than the damper rubber 16, it is possible to set the striking sounds 1, 2 at a larger level than the striking sound 3 which occurs when the butting part 27 of the pawl lever 15 strikes this damper rubber 16.

In other words, out of the striking sounds 1, 2, 3 which occur when the door latch device 11 is operated, the first two striking sounds 1, 2 are intentionally generated at a determined interval and at determined sound pressures, and at the same time, the last striking sound 3 is muffled, whereby the striking sounds 1, 2 are resonated. Therefore, the striking sounds 1, 2 can be heard as a single sound by the passengers. Moreover, because the striking sounds 1, 2 can be resonated, quality of sound, tone of the sound and volume level of the sound can be improved. In this manner, mechanical sounds can be heard comfortably.

Accordingly, the sound pressures of all the striking sounds which occur will not be lowered by employing the muffling structure as in the conventional door latch device, but feeling of click can be obtained by improving sound quality of the occurring sound. As the results, the quality of the vehicle will be enhanced, and the vehicle can be provided with such identity as different from the other vehicles.

Further, an irregularly curved part 28 may be formed in the locking part 23, as shown in FIG. 5, so that the striker 12 may be deeply butted (so as to be substantially flush with) against the locking part 23. This irregularly curved part 28 is formed in a concave shape from an outer periphery of the fork 14. Because the striker 12 can be butted from the perpendicular direction of the irregularly curved part 28, sound quality of the striking sound 1 can be effectively improved.

Alternatively, an inclined part 29 may be provided in the locking part 24, as shown in FIG. 6, by coating the resin 20 in an inclined manner that the coating becomes thicker as a distance from a rotation center of the fork increases, so that muffling effect due to the resin 20 in the region close to the periphery may become higher as the distance increases. Because, in the half-latched state, the entering speed of the striker 12 varies depending on the closing speed of the door, the rotation speed of the fork 14 also varies. Accordingly, the position where the pawl part 26 of the pawl lever 15 is first butted against the locking part 24 also varies depending on the closing speed of the door.

As the closing speed of the door becomes larger, the pawl 26 of the pawl lever 15 is butted against the locking part 24 at position A (a second peripheral position) (a position further away from the rotation center of the fork 14). In other words, the pawl 26 I butted against the side where wall thickness f the inclined part 29 is increased. On the other hand, as the closing speed of the door becomes smaller, the pawl 26 of the pawl lever 15 is butted against the locking part 24 at position B (a first peripheral position) (a position closer to the rotation center of the fork 14). In other words, the pawl 26 is butted against the side where the wall thickness of the inclined part 29 in the locking part 24 so that wall thickness of the resin 20 may b gradually increased in a radial direction of the fork 14, it is possible to stably generate a striking sound, even though the closing speed of the door has changed.

Therefore, according to the door latch device of the invention, the door latch device includes a striker, a fork that grasps or releases the striker, a pawl lever that locks rotation of the fork in a half-grasped state or in a full-grasped state of the fork, the fork having a first locking part which locks the striker when the fork is shifted from an open state through the half-grasped state to the full-grasped state and a second locking part which is locked with the pawl lever in the half-grasped state, a stopper member which restricts rotation of the pawl lever, and a sound adjusting unit that makes a first striking sound which occurs when the striker strikes the first locking part larger than a third striking sound which occurs when the pawl lever strikes the stopper member in the full-grasped state of the fork, and that makes a second striking sound which occurs when the pawl lever strikes the second locking part larger than the third striking sound. In this manner the striking sounds 1, 2 can be intentionally resonated at a determined interval and at a determined sound pressure thereby to improve the quality, and tone of the sound and the sound level. Because the mechanical sound can be comfortably heard as a single sound by the passenger, the quality of the vehicle will be enhanced, and the vehicle can be provided with such identity as different from other vehicles.

Moreover, because the locking parts 23 and 24 coated with the thin resin 20 have smaller muffling effects than the damper rubber 16, it is possible to reliably generate the striking sounds 1, 2 so as to be larger than the striking sound 3, and feeling of click can be obtained.

Further, by forming the irregularly curved part 28 in a concaved shape or in a swelled shape so that the striker 12 may be deeply butted (so as to be substantially flush with) against the locking part 23, the striker 12 can be butted from a perpendicular direction of the irregularly curved part 28. Therefore, the striking sound 1 can be effectively improved.

Still further, by forming the inclined part 29 in the locking part 24, so that muffling effect in the region close to the periphery of the fork 14 may be higher than in the region close to the center of the fork 14, it is possible to stably generate the striking sound 2, even though the position where the pawl part 26 of the pawl lever 15 is butted against the locking part 24 has changed according to the closing speed of the door.

The invention can be applied to the door latch device in which sound quality will be enhanced.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A door latch device, comprising:

a striker;

a fork that grasps or releases the striker, while being rotated, with a speed in accordance with a closing speed of a door, about a rotation center thereof between an open state and a full-grasped state by way of a half-grasped state, the fork including;

a first locking part that abuts the striker upon closing a door when the fork is in the open state, a grasping part that receives the striker after the first locking part abuts the striker, and a second locking part;

a pawl lever that locks the rotation of the fork in the half-grasped state of the fork by engaging with the second locking part, and locks the fork in the full-grasped state of the fork by engaging with the first locking part;

a stopper member to which the pawl lever strikes when the pawl lever engages with the first locking part, the stopper member being made of an elastic material; and a resin coating provided on the second locking part, wherein the second locking part includes a first peripheral position where the pawl lever first strikes when the fork in the half-grasped state is rotated at a first speed, and a second peripheral position where the pawl lever first strikes when the fork in the half-grasped state is rotated at a second speed greater than the first speed, a distance between the rotation center of the fork and the second peripheral position being greater than a distance between the rotation center and the first peripheral position, and the resin coating having a first thickness, at the first peripheral position, and a second thickness, at the second peripheral position, greater than the first thickness, wherein the resin coating continuously increases in thickness as the resin coating extends from the first peripheral position to the second position, such that when the pawl lever strikes the second locking part, a substantially uniform sound is generated regardless of a rotation speed of the fork, and wherein no hollow part is formed in the resin coating.

2. The door latch device as claimed in claim 1, wherein the resin is also provided on the first locking part, and the resin and the stopper member are provided such that a first striking sound, which occurs when the striker strikes the first locking part and a second striking sound, which occurs when the pawl lever strikes the second locking part are larger than a third striking sound, which occurs when the pawl lever strikes the stopper member as the fork is rotated to the full-grasped state.

* * * * *